United States Patent [19]

Spector et al.

[11] Patent Number: 4,583,597

[45] Date of Patent: Apr. 22, 1986

[54] FIRE AND EXPLOSION DETECTION AND SUPPRESSION SYSTEM

[76] Inventors: Dov Spector, 36 Har-Dafna Street, Savion; Yehiel Spector, 5 Avner Street, Zahala-Tel Aviv, both of Israel

[21] Appl. No.: 744,652

[22] Filed: Jun. 14, 1985

Related U.S. Application Data

[63] Continuation of Ser. No. 615,899, May 30, 1984, abandoned, which is a continuation of Ser. No. 268,236, May 29, 1981, abandoned, which is a continuation of Ser. No. 902,608, May 3, 1978, Pat. No. 4,270,613.

[30] Foreign Application Priority Data

May 3, 1978 [IL] Israel ..... 54138

[51] Int. Cl.[4] ..... A62C 37/18

[52] U.S. Cl. ..... 169/61; 340/578; 250/338

[58] Field of Search ..... 169/62, 61, 60, 56, 169/16, 26, 5, 54; 340/507, 508, 531, 578, 636, 600; 250/338, 372

[56] References Cited

U.S. PATENT DOCUMENTS

| | | | |
|---|---|---|---|
| 3,665,440 | 5/1972 | McMenamin | 250/338 |
| 3,762,477 | 10/1973 | Mobley, Sr. | 169/61 |
| 3,825,766 | 7/1974 | Connor et al. | 169/61 |

*Primary Examiner*—F. J. Bartuska
*Assistant Examiner*—Kenneth Noland
*Attorney, Agent, or Firm*—Browdy and Neimark

[57] ABSTRACT

A fire and explosion suppression system which is operative for suppressing an explosion within 100 milliseconds of the existence of a high energy ignition and within 200 milliseconds of the existence of a low energy ignition. Acutation circuitry for this system is also disclosed and claimed and includes circuitry operative in two different modes having different sensitivities and response and well as circuitry for sensing the failure of suppression elements to operate and for actuation of additional suppression elements in response to this sensed failure.

11 Claims, 13 Drawing Figures

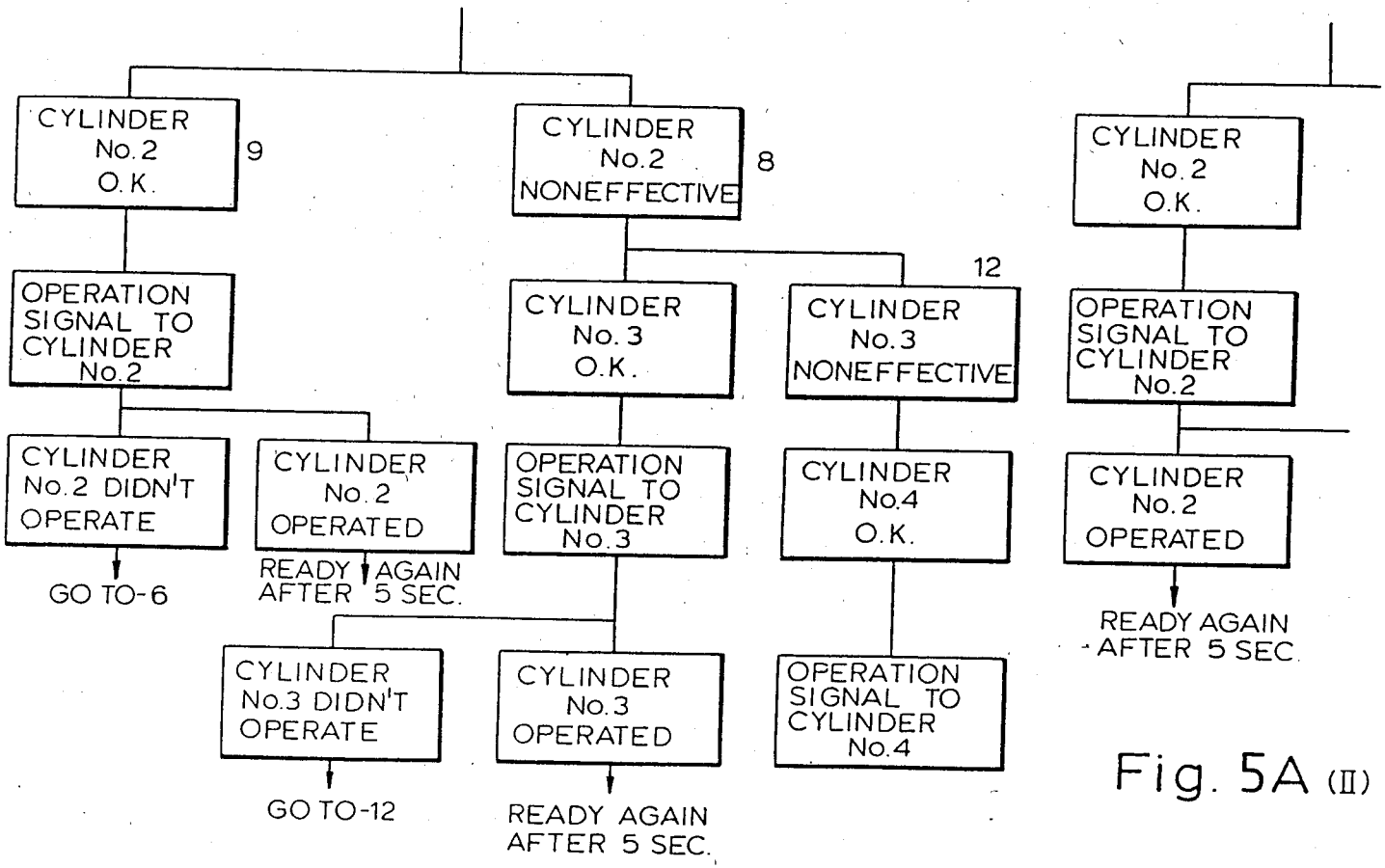
Fig. 5A (II)

Fig. 5A (III)
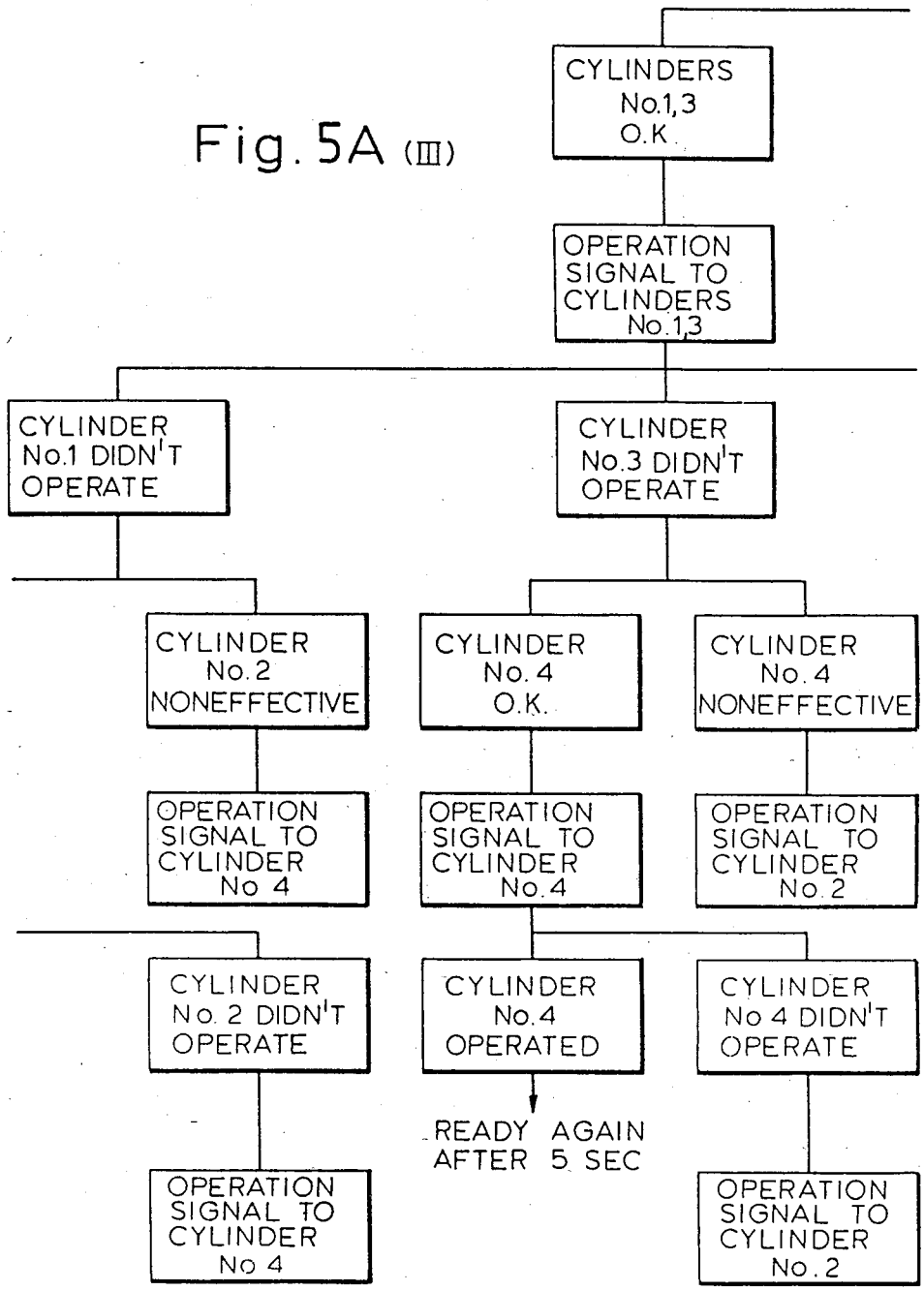

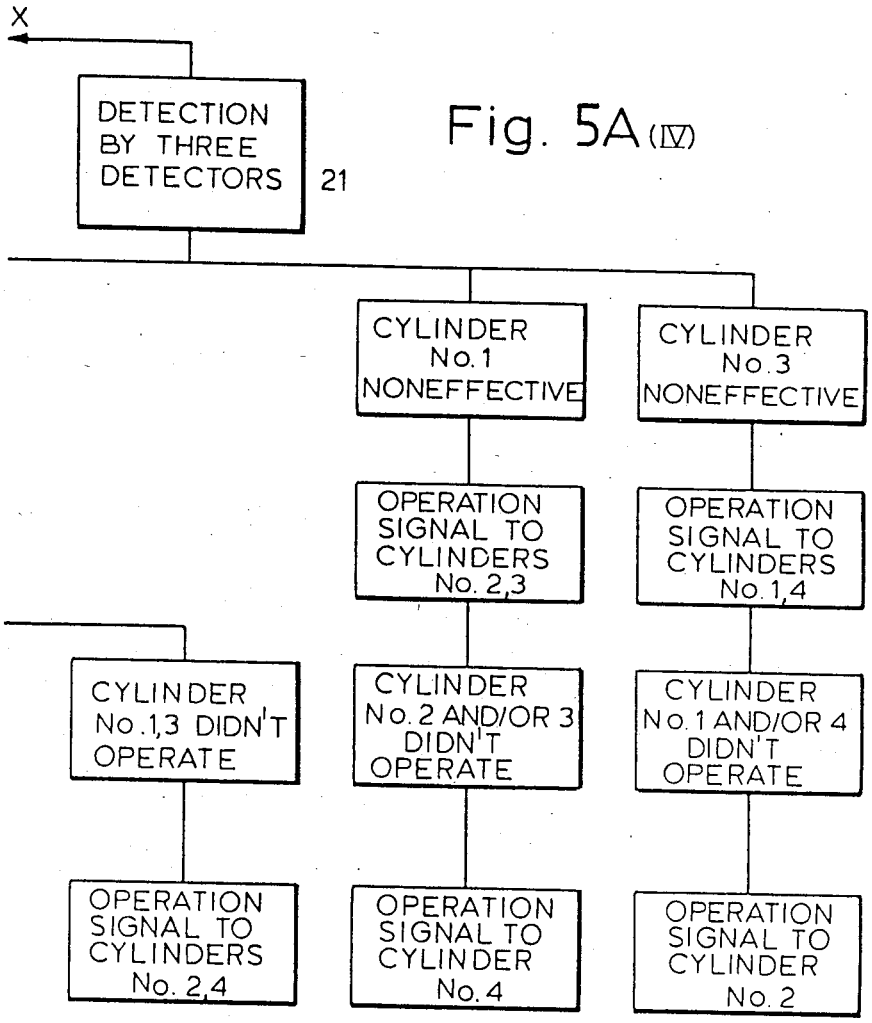
Fig. 5A (IV)

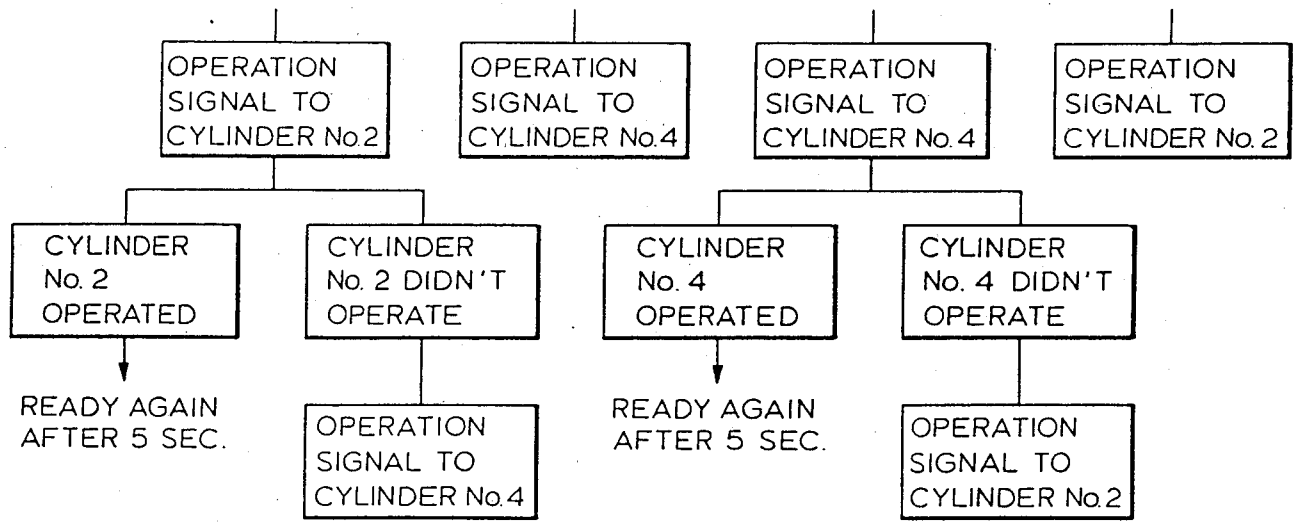
Fig. 5B (II)

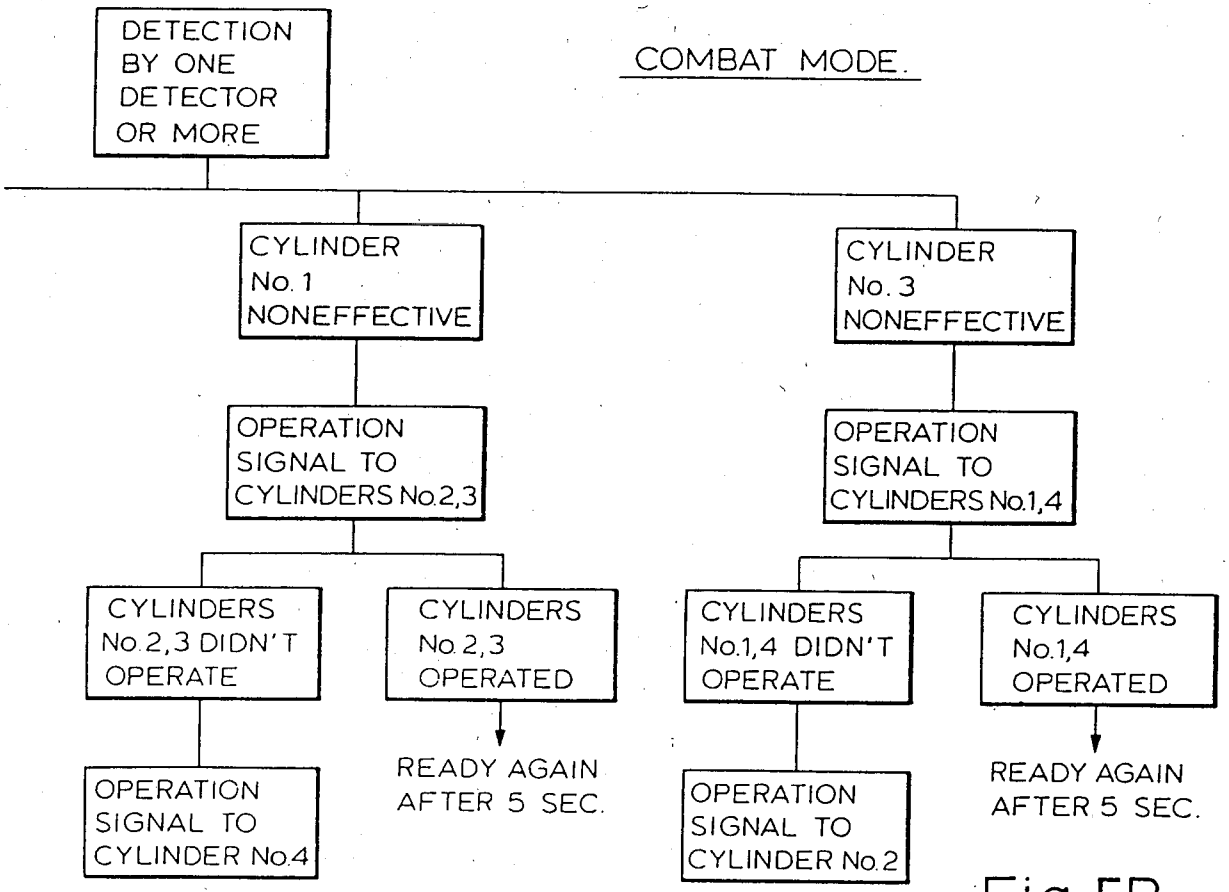
Fig. 5B (III)

FIRE AND EXPLOSION DETECTION AND SUPPRESSION SYSTEM

This application is a continuation of Ser. No. 615,899, filed on May 30, 1984, now abandoned, and which is a continuation of Ser. No. 268,236, filed on May 29, 1981, now abandoned, and which is a continuation of Ser. No. 902,608, filed May 3, 1978, now U.S. Pat. No. 4,270,613.

BACKGROUND OF THE INVENTION

The present invention relates to fire and explosion prevention systems.

Many systems are known on the market and have been proposed for fighting fires. Such systems employ thermal, light, heat or pressure detectors to determine the existence of a fire or explosion and to actuate fire extinguishing units and are known to be effective for suppressing fires of various origins.

There is no system presently on the market capable of effectively suppressing incipient explosions from both high energy and low energy ignitions. In order to effectively suppress an explosion such as that arising when a HEAT (High Energy Anti Tank) round strikes an armored vehicle, it is necessary to achieve suppression within approximately 100 msecs. following the onset thereof. If suppression can be achieved in this time frame, skin burns to exposed personnel can be limited to first degree and the pressure build-up can be limited to one atmosphere.

The present invention also relates to detectors for automatically sensing the presence of a dangerous condition and energizing appropriate protective apparatus. Many types of detectors are known for sensing various dangers or potentially dangerous conditions. Pressure and temperature detectors are well known as are optical flame and smoke detectors. Fire detection by sensing emitted ultraviolet radiation is also well known.

In the design of such detectors and more particularly in the design of explosion detectors, two conflicting design criteria operate. The first is minimalization of the reaction time in which an output indication signal can be provided to protective apparatus and second is reliability in the presentation of false alarms. Particularly with respect to explosion protection the short reaction time is critical since remedial measures against most types of explosion must be taken within approximately 100 msec of the onset thereof in order to prevent serious damage to life and property. Reliability is also critical since such explosion detectors are often coupled to automatic explosion prevention apparatus and it is extremely desirable that each apparatus not be operated except in the case of actual need.

A number of fire and explosion detection systems have been proposed.

Two relevant examples are illustrated in U.S. Pat. Nos. 3,825,754 and 3,931,521. U.S. Pat. No. 3,931,521 describes a dual spectrum infrared fire detector which is activated by the coincident receipt of radiant energy in 7–30 micron spectral band and in 0.7–1.2 micron spectral band. The long wave length spectral band is detected by using a thermal detector such as a thermopile. The detector system described in U.S. Pat. No. 3,391,521 suffers from the disadvantage that the short wave length detector is responsive to light in the visible band which is transmitted through the atmosphere, and the long wavelength detector operates in a region of relatively high noise. Thus, the device operates at a relatively low sensitivity threshold of operation.

U.S. Pat. No. 3,825,754 describes a dual spectrum infrared fire detector similar to that described in U.S. Pat. No. 3,931,521 and also comprises a three channel infrared radiation detection system for distinguishing between large explosive fires and large explosions which cause no fire. The system described in U.S. Pat. No. 3,825,754 shares the disadvantages of the system described in U.S. Pat. No. 3,931,521, as discussed hereinabove.

U.S. Pat. No. 3,665,440 shows a combination ultraviolet and infrared detection system which provides an output only in the absence of ultraviolet radiation during the receipt of infrared radiation. Such a detector system is not suitable for use in detecting incipient explosions.

U.S. Pat. No. 3,653,016 shows a combination infrared light detector and ultraviolet light detector coacting as a fire discrimination system. Since visible light is detected the false alarm rate of such a detector is increased when visible light is present in the detection environment.

SUMMARY OF THE INVENTION

The present invention seeks to overcome disadvantages and limitations of prior art apparatus and provides a fire and explosion suppression system comprising:

detector apparatus operative to determine the existence of a fire or an incipient explosion in a volume to be protected and to provide a first output indication in response thereto;

extinguishing agent distribution means operative for discharging an extinguishing agent into said protected volume in response to an actuation indication; and actuation means operative in response to said first output indication for providing said actuation indication to said distribution means;

said system being operative for suppressing an explosion within 100 milliseconds of the existence of a high energy ignition and within 200 milliseconds of the existence of a low energy ignition.

Also in accordance with an embodiment of the invention the detector apparatus comprises:

a first detector for sensing radiation within a first frequency range outside the visible spectrum and providing an output indication I in response to receipt of such radiation;

a second detector for sensing radiation within a second frequency range outside the visible spectrum and providing an output indication II in response to receipt of such radiation; and logic means for ANDing said output indications I and II and providing an output indication III of simultaneous receipt of radiation within said first and second frequency ranges.

Additionally, in accordance with an embodiment of the invention extinguishing agent distribution means comprises a quick response pressure detector providing an indication of steady state pressure at which said extinguishing agent is maintained and a discharge indication indicating release of said extinguishing agent.

Further in accordance with an embodiment of the invention extinguishing agent distribution means also comprises low drag deflection means for directing a high speed fluid flow of extinguishing agent into said protected volume, the deflection means having a plurality of generally planar elements joined to each other at their respective edges or drawn from one piece to define a common apex and arranged about an axis passing through said apex which is directed parallel to and facing the incoming fluid flow.

BRIEF DESCRIPTION OF THE DRAWINGS

The invention will be more fully understood and appreciated from the following detailed description taken in conjunction with the drawings in which:

FIG. 7B is a view taken along the section lines B-B of FIG. 7D; FIG. 7A is a view looking in the direction of lines A-A of FIG. 7C;

FIG. 8A is a view taken along the section lines A-A of FIG. 8B.

DESCRIPTION OF THE PREFERRED EMBODIMENTS

Figure 1:
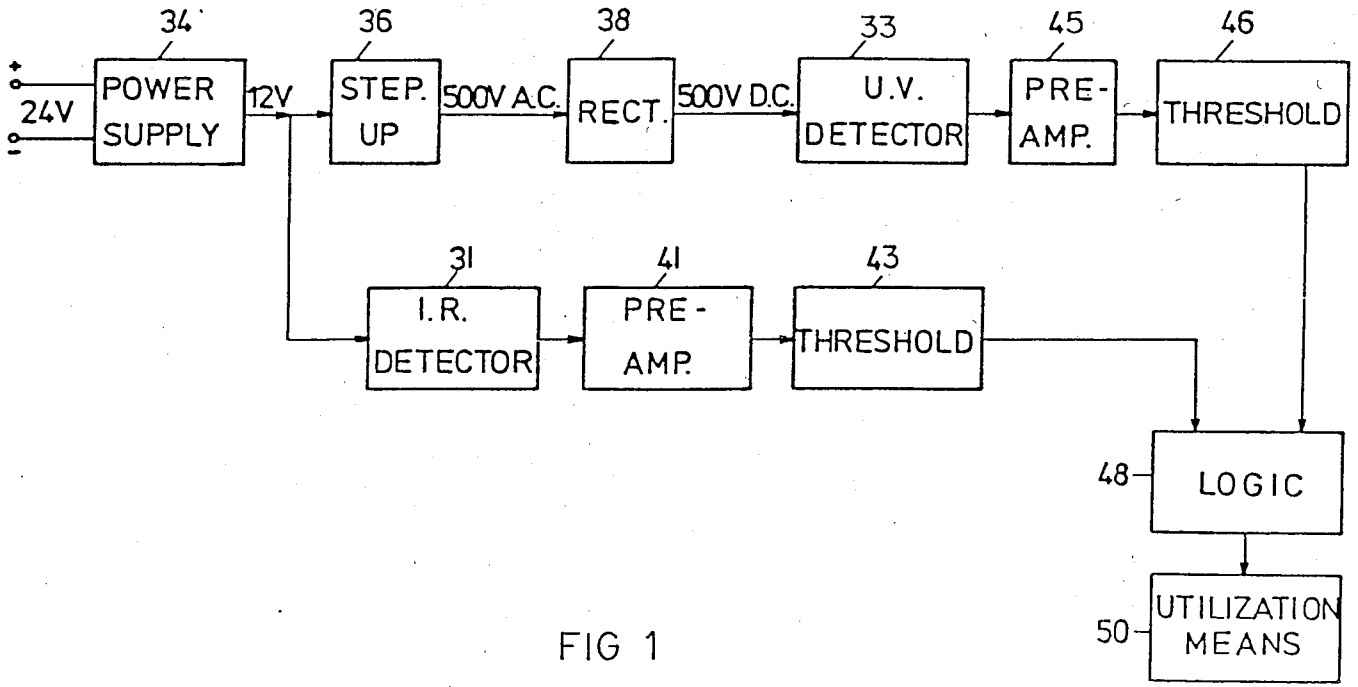
FIG. 1 is a block diagram of fire and explosion detection apparatus constructed and operative in accordance with an embodiment of the invention.

Referring now to FIG. 1 there is shown fire and explosion detection circuitry constructed and operative in accordance with an embodiment of the invention and comprising an infrared radiation detector 31 and an ultraviolet radiation detector 33. Infrared radiation detector 31 may be any suitable type of infrared detector operating in the wave length range of 1.5 to 3.0 microns and typically receives current from a 12 or 24 volt DC power supply 34. Such an infrared radiation detector is Model P 398 R manufactured by HAMAMATZO TV CO.

According to a preferred embodiment of the invention, the detection wave length range of infrared detector 31 is limited to the range of 2.5–2.75 microns. Radiation at these wavelengths is substantially absorbed by the earth's atmosphere, thus reducing the incidene of false alarms.

Ultraviolet detector 33 is typically a detector similar to that employed in an Edison Model 630, produced by the McGraw Edison Company of the U.S.A. and operates in a wave length range of up to 0.3 microns.

It is a particular feature of the present invention that both the IR detector 31 and the UV detector 33 operate outside of the range of visible light. As a result they may operate at relatively high sensitivity levels without encountering an unacceptable false alarm rate, as would occur were visible radiation sensed.

The output of infrared detector 31 is supplied to a pre-amplifier 41 and the amplified output thereof is supplied to threshold circuitry 43. Similarly the output of ultraviolet radiation detector 33 is supplied to a pre-amplifier 45 whose amplified output is received by a threshold circuitry 46. The respective outputs of threshold circuitry 43 and 46 are supplied to logic circuitry 48 which may typically be an AND gate. The output indication supplied by logic circuitry 48 in the simultaneous presence of alarm indicating signals from threshold 43 and 46 is applied to utilization means 50 which may be alarm means or alternatively or additionally automatic explosion suppression apparatus such as referred to hereinabove.

Figure 2:
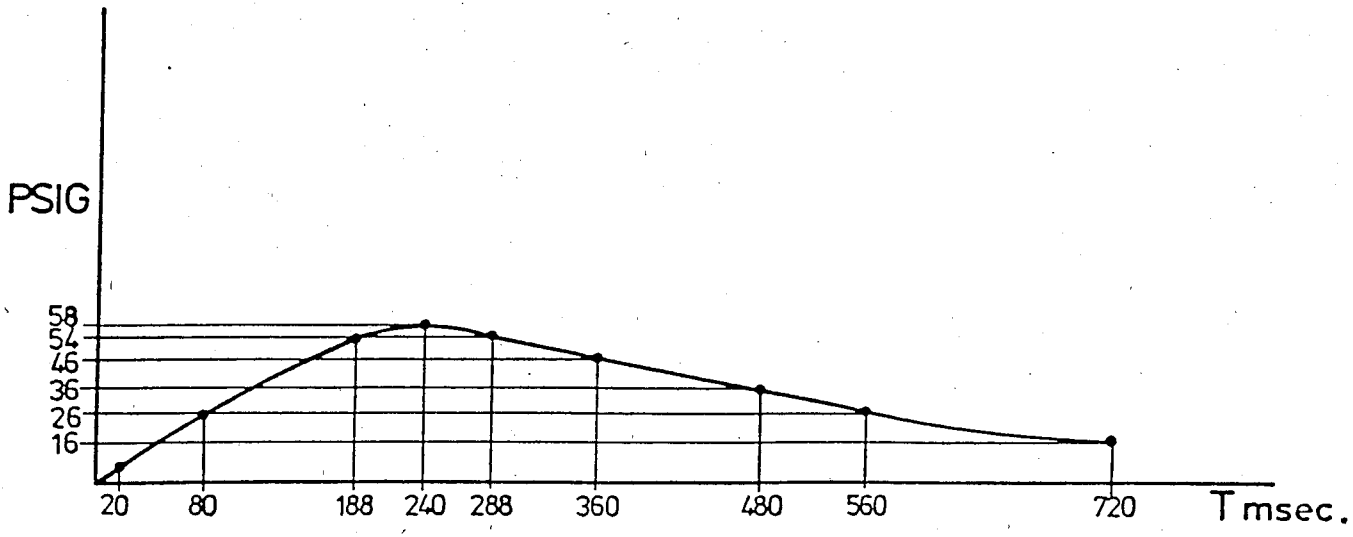
FIG. 2 is a plot of pressure versus time in an explosion situation.

The importance of quick reaction time in explosion detection may be appreciated from a consideration of FIG. 2 which shows the rise in pressure within an enclosure which is at least partially sealed as a function of time following ignition of an explosive mixture. The plot of FIG. 2 begins approximately 40–120 msecs. following ignition thus indicating that in a typical case pressure begins to be generated approximately 40–120 msecs. after ignition. It is appreciated that the precise configuration of the curve in FIG. 2 and the onset and peak of pressure build/up can vary as a function of the particular energy source ignited and the configuration of the surrounding enclosure.

From the typical case illustrated in FIG. 2 it is seen that the peak of the explosion occurs approximately 240 msecs. following the onset of pressure build-up. Thus, in order to suppress an explosion having the characteristics illustrated in FIG. 2 before its peak is approached it is necessary to detect initiation of an instant of ignition within 40–100 msecs. prior to pressure build-up and to achieve suppression within approximately 160 msecs. following detection.

The detection apparatus described hereinabove is eminently suitable for performance of this task. Taking for example the apparatus illustrated in FIG. 1 such apparatus has been experimentally constructed and tested and found to have a response time of less than 5 msecs. thus producing an output signal within 10 msecs. of penetration of a HEAT (High Energy Anti Tank) round into an armored vehicle.

Figure 3:
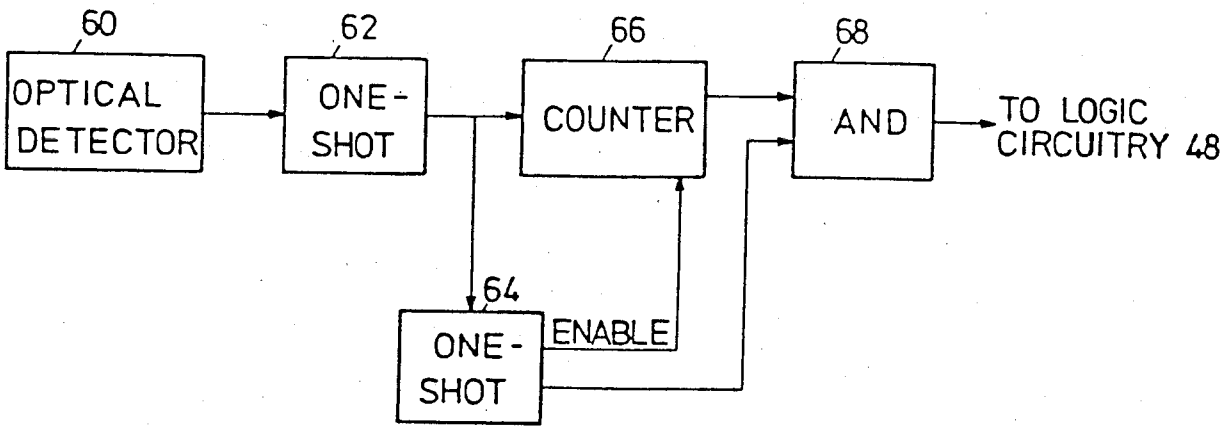
FIG. 3 is a block diagram of signal processing circuitry which may be employed in the apparatus of FIG. 1.

Referring now to FIG. 3 there is shown signal processing circuitry for the prevention of false alarms which may suitably be incorporated in the threshole detector circuitry employed in the embodiments of FIG. 1 or added to the apparatus shown therein as an additional element. The purpose of such signal processing circuitry is to distinguish between detection of spurious signals and detection of an alarm condition.

In the use of optical detectors such as a UV apparatus, a detector 60 supplies output signals to a one shot circuit 62 (monostable multivibrator) which converts each of the signals to a signal of uniform duration and amplitude. The output of one shot circuit 62 is supplied to the input of a counter 66 and to a second one shot circuit 64. One shot circuit 64 determines the counting time and provides an enable signal to counter 66 for a predetermined duration of time in response to the receipt of an output signal from one shot circuit 62. One shot circuit 64 is typically automatically reset so as to enable repeated clearing of the counter and resumption of counting.

Counter 66 is operative to count the uniform pulses received from one shot 62 for the duration of time determined by one shot circuit 64. If at the end of this duration a predetermined number of pulses, typically 5–10, have been counted, which number indicates the presence of an alarm condition, counter 66 supplies an output signal to an AND gate 68. AND gate 68 also receives an input from second one shot circuit 64 which indicates termination of the counting period. In the simultaneous presence of signals from counter 66 and second one shot 64, AND gate 68 produces an output signal to logic circuitry 48 indicating detection of an alarm condition.

It is appreciated that the circuitry illustrated herein is merely exemplary of a wide range of logic and detection circuitry which may be employed for detection in accordance with various embodiments of the invention. In fact, reference may be had to our copending U.S. patent application, Ser. No. 902,609, filed May 3, 1978, and of common assignment herewith, for a further example of such logic and detection circuitry.

Figure 4:
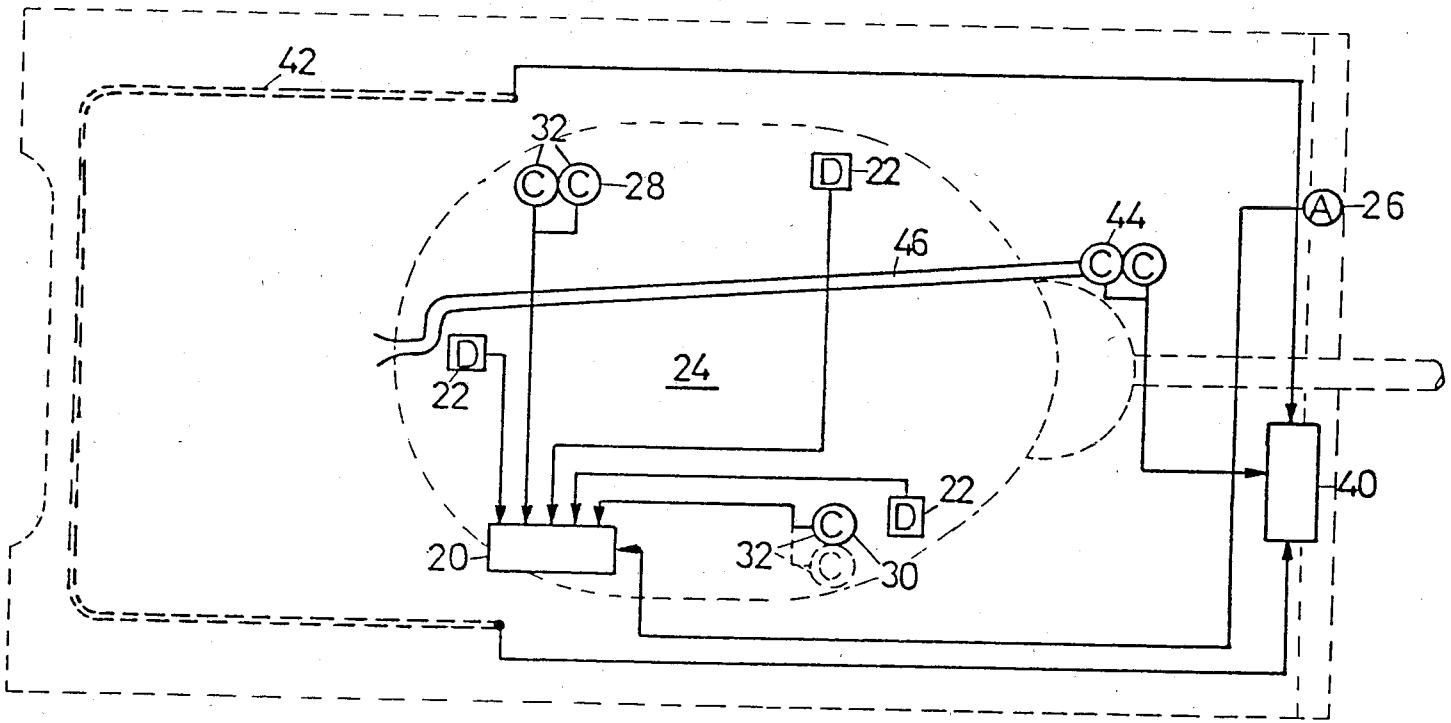
FIG. 4 is a schematic illustration showing the placement of extinguishing material containers and associated equipment in a typical armored vehicle in accordance with an embodiment of the invention.
Figure 5A:
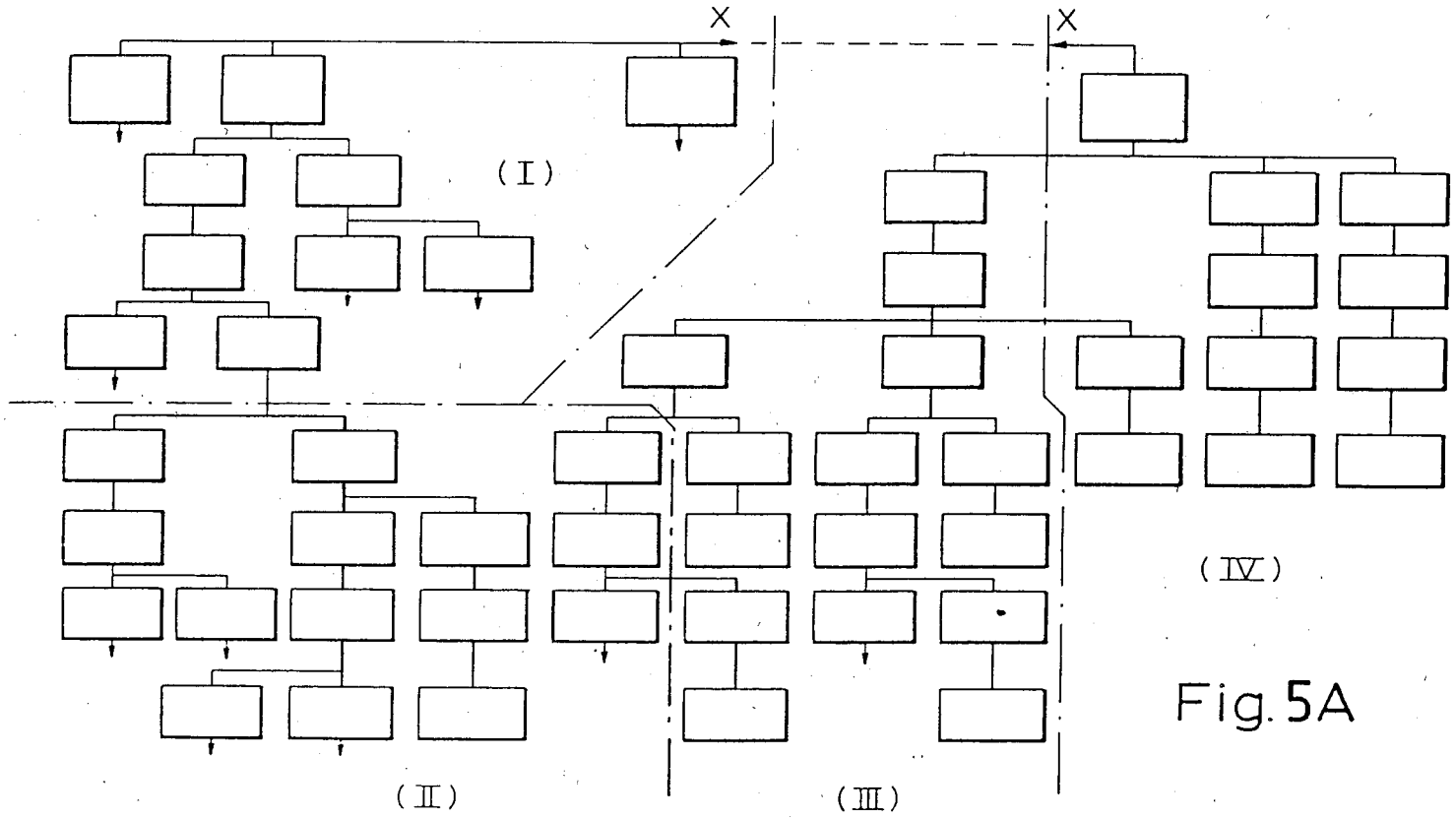
FIGS. 5A and 5B are flow charts respectively illustrating normal and combat modes of the logical operation of actuation circuitry constructed and operative in accordance with an embodiment of the invention.
Figure 5A:
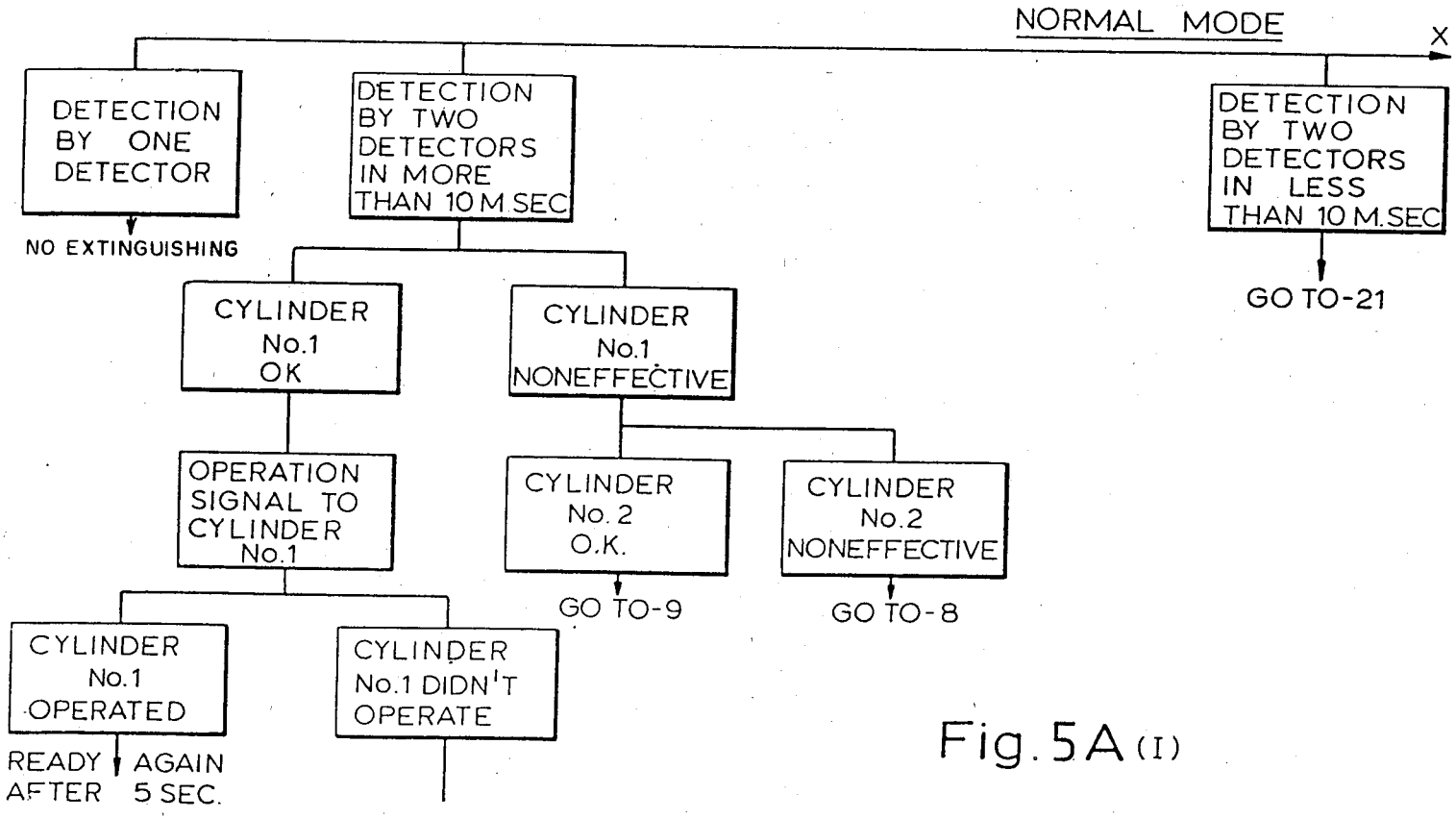
Figure 5B:
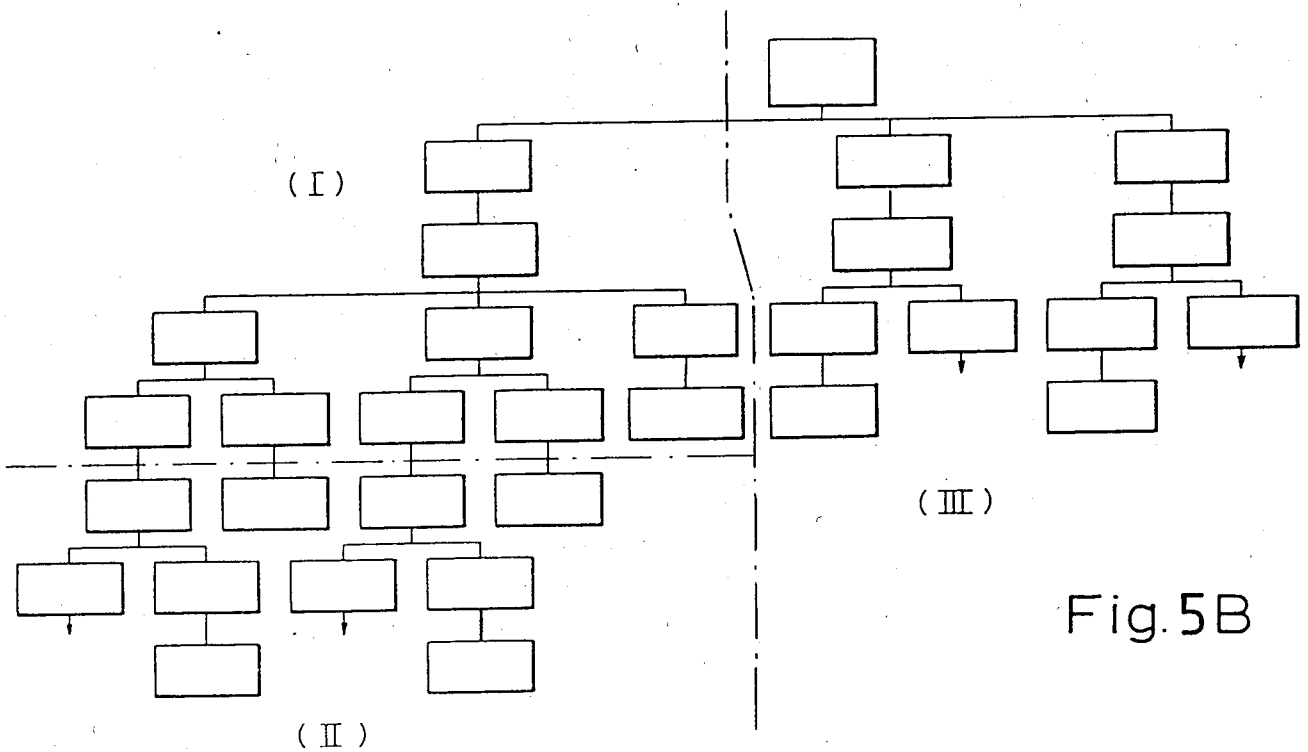
Figure 5B:
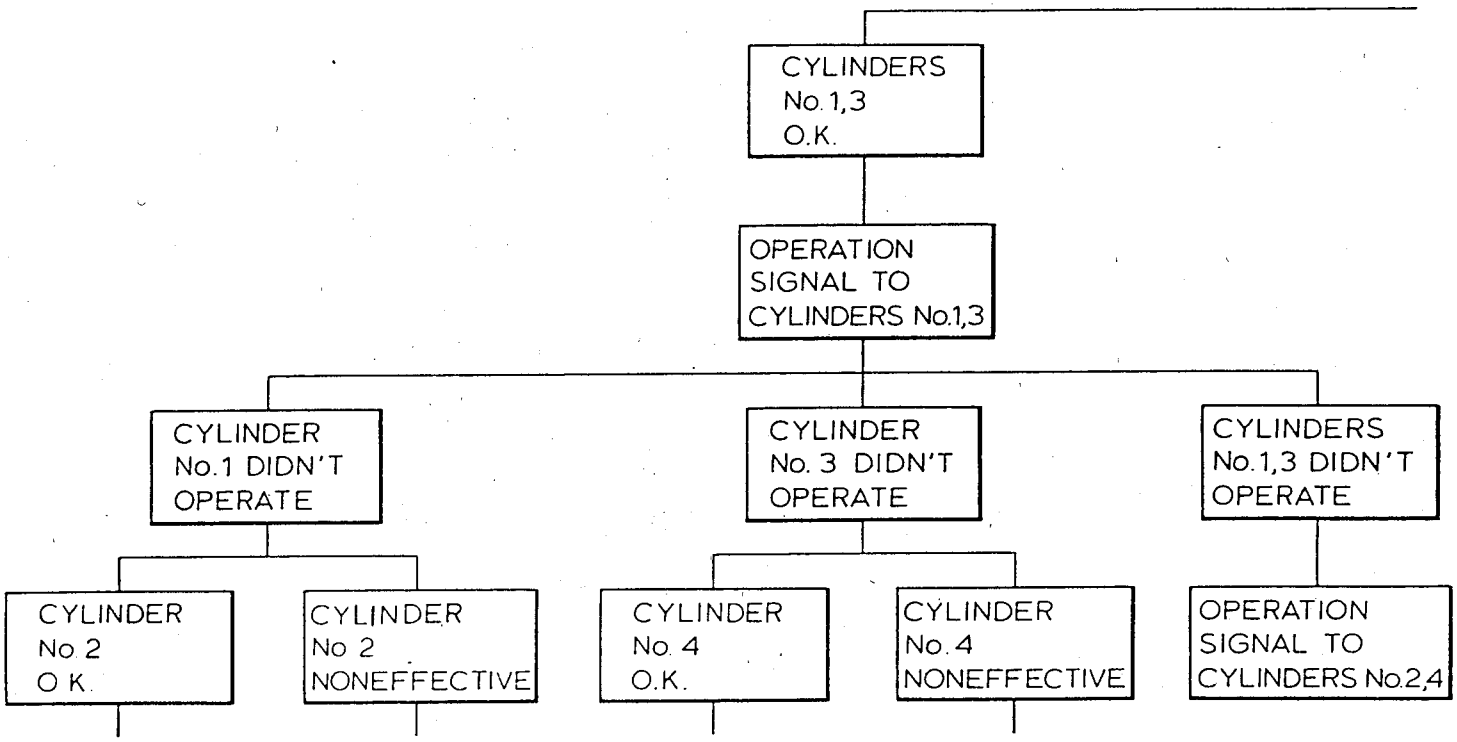

Reference is now made to FIG. 4 which illustrates in schematic form the placement of fire and explosion detection and suppression apparatus in a typical armored vehicle. The apparatus is divided into two operational sub-systems, System I for the protection of the Troop Compartment and System II for the protection of the Engine Compartment. The operation of the individual sub-system will be described hereinafter in connection with FIG. 5.

System I comprises control circuitry 20 which receives alarm inputs from three detector assemblies 22 distributed in the Troop Compartment 24, which is indicated in oval outline. Detector assemblies 22 comprise detectors of the type described hereinabove. Control circuitry 20 also receives an input signal from a manually actuable trigger switch 26 located at the outside of the vehicle.

Control circuitry 20 is electrically coupled to a pair of extinguishing agent distribution assemblies 28 and 30. Assembly 28 typically comprises two extinguishing agent containers 32 while assembly 30 may comprise either one or two such containers. Containers 32 and the apparatus associated therewith will be described hereinafter in detail in connection with FIGS. 6–8. The placement and orientation of the containers is determined empirically for each configuration of vehicle or other volume to be protected in order to provide speedy and uniform distribution of the extinguishing agent upon actuation of the system. For the purposes of the discussion which follows, it will be understood that each of containers 32 is equipped with a discharge valve and a pressure sensor. The pressure sensor provides a continuous indication of the operability of the cylinder, in the sense of it being fully pressurized, and an immediate indication of the discharge thereof.

System II, for protection of the Engine Compartment, located, in the illustrated embodiment, at the rear of the armored vehicle, comprises control circuitry 40 which is activated by a wire type heat detector 42 which extends along the periphery of the engine compartment. Heat detector 42 may be, for example, a model WK 716287 manufactured by Walter Kidde of the U.S.A. The control circuitry 40 may also be actuated by a manually actuable trigger switch, such as switch 26.

Control circuitry 40 serves to actuate an extinguishing agent distribution assembly 44 which is located at the front of the vehicle and in fluid communication, via a suitable conduit 46 with the engine compartment at the rear thereof.

Systems I and II are supplied with electrical power through suitable main and backup power systems and are designed to function even when the vehicle is otherwise disabled.

The control circuitry 20 indicated schematically in FIG. 4 is operative in two alternative modes, a normal mode where the likelihood of hostile fire is negligible, and a combat mode, wherein hostile fire is possible. The precise operation of the control circuitry, which comprises conventional logic circuitry components will now be completely described with reference to the flow charts provided in FIGS. 5A and 5B. These charts refer to an installation having four containers 32.

In normal mode operation, (FIG. 5A) using three detector assemblies, four alternative possibilities are considered. If only one detector assembly is activated there is no response.

If two detector assemblies are activated within a time span of more than 10 msecs., and cylinder #1 is operable, cylinder #1 is actuated. Once discharge is completed, the system is ready for normal operation after five seconds. If cylinder #1 fails to discharge and cylinder #2 is operable, cylinder #2 is actuated. Once discharge is completed the system is ready for normal operation after five seconds.

If cylinder #2 fails to discharge when actuated or if both cylinders #1 and #2 are inoperable, cylinder #3 is actuated if operable. Once discharge is completed the system is ready for normal operation after five seconds. If cylinder #3 is inoperable or fails to discharge when actuated, cylinder #4 is actuated if operable.

In the event that two detector assemblies are activated within a time span of less than 10 msecs. or if all three detector assemblies are activated, cylinders #1 and #3 are both activated if operable. If cylinder #1 is inoperable or fails to discharge when actuated, cylinder #2 is actuated if operable. If cylinders #2 or #3 are inoperable or fail to discharge when actuated, cylinder #4 is actuated if operable. If cylinders #3 and #4 are inoperable or fail to discharge when actuated and cylinder #1 operates properly, cylinder #2 is actuated if operable. Once two cylinders discharge, the system is ready for normal operation after five seconds, to the extent that operable cylinders remain.

The system operates in the Combat Mode (FIG. 5B) in response to a manually entered indication. During operation in the Combat Mode, the system operation is the same irrespective of the number of detector assemblies which are activated at the same time. Thus, in response to detection by one or more detector assemblies, the control circuitry actuates cylinders #1 and #3 if operable. If cylinder #1 is inoperable, cylinders #2 and #3 are actuated if operable. Similarly if cylinder #3 is inoperable, cylinders #1 and #4 are actuated if operable.

If cylinder #1 fails to discharge when actuated, cylinder #2 is actuated if operable. If cylinder #2 is either inoperable or fails to discharge when actuated, cylinder #4 is actuated if operable. Similarly if cylinder #3 fails to discharge when actuated, cylinder #4 is actuated if operable. If cylinder #4 is either inoperable or fails to discharge when actuated, cylinder #2 is actuated if operable.

If both cylinders #1 and #3 fail to discharge when actuated, then cylinder #2 and #4 are actuated if operable.

Once two cylinders discharge properly, the system is once again ready for operation after five seconds to the extent that operable cylinders remain.

It is a particular feature of the invention, that the operations described above take place in very short periods of time, in the order of milliseconds to substitute operable containers for inoperable or inoperative containers in sufficient time to suppress an explosion. Reference is made to our copending U.S. patent application, Ser. No. 902,610, filed May 3, 1978, and of common assignment herewith, for a block diagram depicting an exemplary layout of conventional logic circuitry components we preferably use to implement the operations of control circuitry 20 described above.

Figure 6:
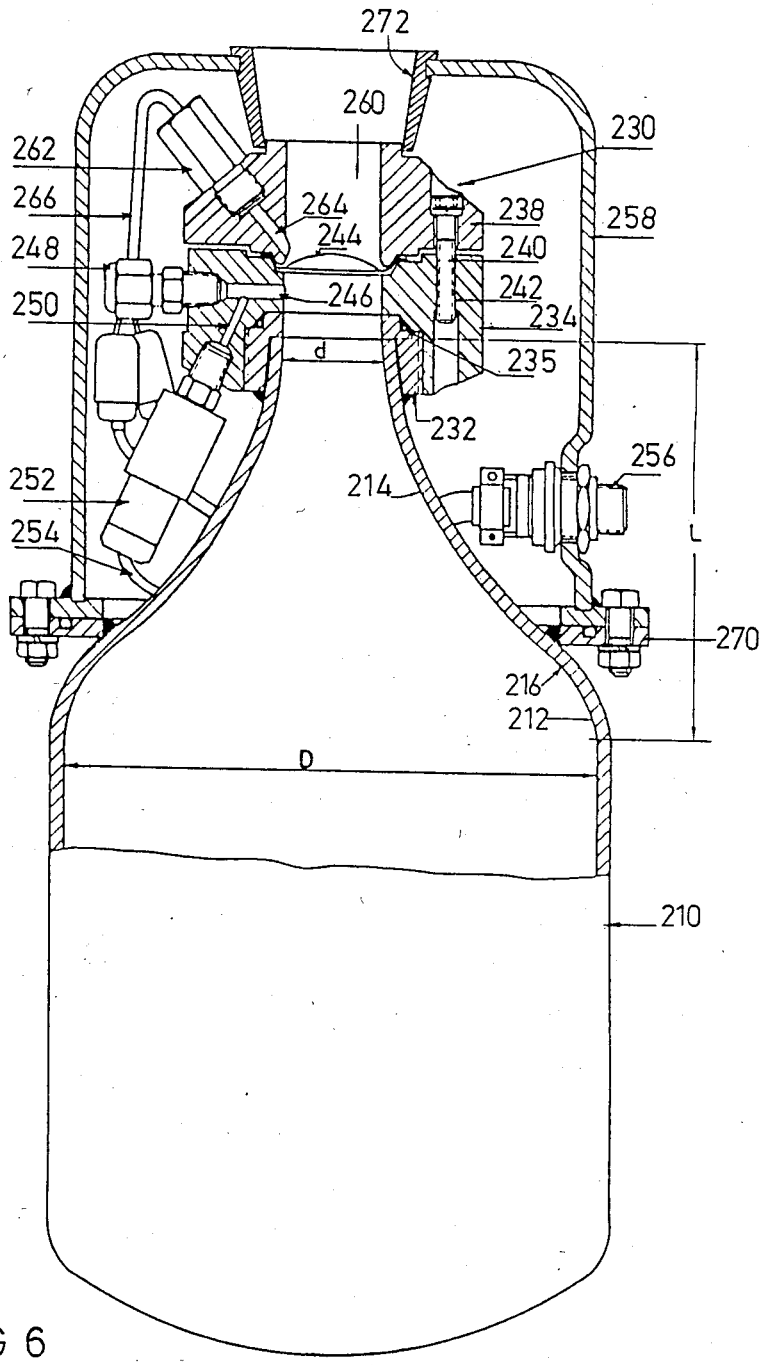
FIG. 6 is an illustration of one embodiment of an extinguishing material container, release valve assembly and pressure monitor constructed and operative in accordance with an embodiment of the invention.
Figure 7B:
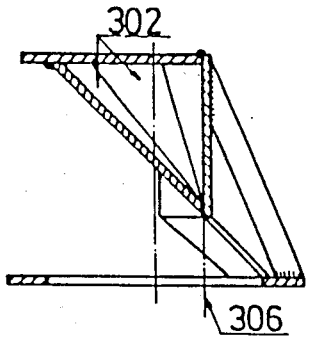
FIGS. 7A, 7B, 7C and 7D are illustrations of one embodiment of a deflector constructed and operative in accordance with an embodiment of the invention.
Figure 7A:
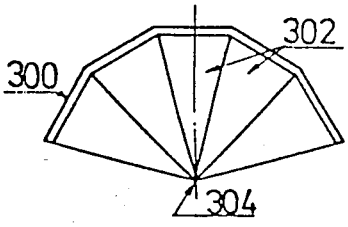
Figure 7C:
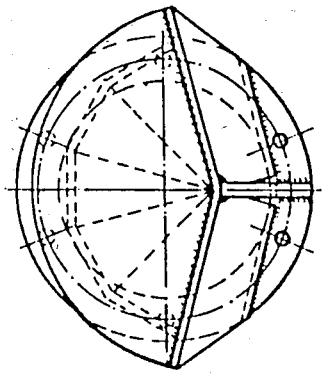
Figure 7D:
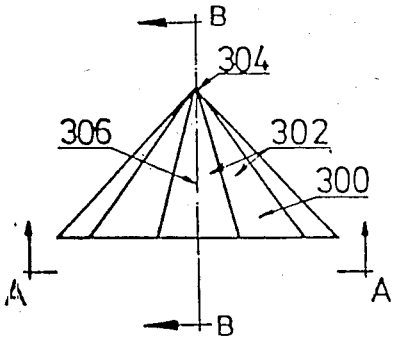

Reference is now made to FIG. 6, which illustrates one embodiment of an extinguishing material container, release valve assembly and pressure monitor constructed and operative in accordance with an embodiment of the invention. It is a particular feature of the invention that the container can empty its contents within 150 milliseconds of receipt of an actuation signal.

The container 210 is of a special construction designed to provide extremely fast emptying thereof. The design parameters of the container and the filling and pressurization thereof will now be described:

On the basis of a calculation of the total volume of a compartment, such as the troop compartment of an armored vehicle, to be protected and the total number and placement of the extinguishing agent containers therein as well as the desired concentration of extinguishing agent in this volume to achieve suppression typically five percent, a determination of the amount of extinguishing agent to be contained in each container is arrived at.

In practice, the container is filled with an extinguishing agent such as Halon 1301, manufactured by Du Pont of the U.S.A. The extinguishing agent is stored in a liquid state under pressure and fills a portion of the container. A pressurizing gas, such as nitrogen, is also contained in the container.

The interrelationship between various parameters which govern the speed at which the extinguishing agent leaves the container outlet is determined by the following approximate expression:

$$U = \left\{ \frac{2g}{r_{fl}} \left[ P_n \left( \frac{v_{no}}{v_{no} + \frac{a}{m_n} \int U dt} \right)^{k_n} + P_f \left( \frac{v_{fo}}{v_{fo} + \frac{a}{m_f} \int U dt} \right)^{k_f} - P_a \right] \right\}^{\frac{1}{2}}$$

where:

U—the outlet speed of the extinguishing agent in a liquid state (ft/sec)

g—the gravitational acceleration (ft/sec$^2$)

$r_{fl}$—the density of the extinguishing agent in a liquid state (lbs/ft$^3$)

$P_n$—the partial pressure of the pressurizing gas in the container (lbs/ft$^2$)

$v_{no}$—the specific volume of the pressurizing gas in the container (ft$^3$/lbs)

a—the effective outlet opening area (ft$^2$)

$m_n$—the weight of the pressurizing gas in the container (lbs)

$k_n$—the polytropic constant of the pressurizing gas (unitless)

$P_f$—the partial pressure of the extinguishing agent vapor (lbs/ft$^2$)

$v_{fo}$—the specific volume of extinguishing agent vapor in the container (ft$^3$/lbs)

$m_f$—the weight of the extinguishing agent in the gaseous phase in the container (lbs)

$k_f$—the polytropic constant of the extinguishing agent (unitless)

$P_a$—atmospheric pressure (lbs/ft$^2$)

The above expression is solved by conventional computer techniques using a trial and error and iteration program. In the program the following parameters are varied: total container volume, the ambient pressure in the container when pressurized, total weight of extinguishing agent, effective outlet opening area and ambient temperature in the operating environment.

The computer program provides for a given emptying time and volume of extinguishing agent, a plurality of combinations of the various parameters from which a useful combination thereof may be selected, on the basis of which the container may be constructed. The value for U, the outlet speed of the extinguishing agent is selected to be sufficiently large to produce the desired concentration of extinguishing agent in the volume within 150 msecs. of actuation.

Once a given combination of parameters has been selected, the amount of extinguishing agent and of nitrogen and thus the container volume and the outlet opening area are known for a given operating environment temperature.

The container dimensions and inner configuration is then determined on the basis that the ratio between the outlet diameter d and the body diameter D should be in the range of 1:5 to 1:10. Limits to these dimensions are determined by installation requirements. The shape of the narrowing portion of the container connecting the body portion of the container to the outlet thereof is determined in accordance with the teachings of Rouss-Hassen set forth at pages 580–581 of the *Engineering Handbook* by S. G. Ettingen, Volume I, 1954 (Hebrew) which determine the relationship between the length of the narrowing portion L which is defined in cross section by two intersecting parabolas 212 and 214 and the body diameter D as well as the relationship between L and the point of intersection 216 of the two parabolas 212 and 214.

In the exemplary embodiment built and tested by applicants the body diameter D is 150 mm, the outlet diameter d is 26 mm and the length L of the narrowing portion is 110 mm. The point of intersection of the parabolas is 90 mm along L from the outlet. The overall length of the container is 275 mm.

The container is made of high strength metal by molding or deep drawing techniques suitable for high pressure applications and is formed with a smooth inner surface to reduce friction.

Coupled to the outlet end of container 210 is a pressure monitor and release valve assembly 230. Assembly 230 comprises a mounting collar 232 which is sealingly attached onto the container adjacent the outlet. A pressure monitor mounting assembly 234 is threadably mounted onto collar 232 and sealed thereonto by an O-ring 235. A second mounting assembly 238 cooperates with mounting assembly 234 and is secured thereonto by means of a threaded screw 24 which engages a threaded socket 242.

Collar 232 and mounting assemblies 234 and 238 all define an exit flowpath 260 for extinguishing agent from the container which extends from the outlet thereof, in a generally coaxial orientation. The flowpath is sealed by a rupture disc 244 mounted between cooperative mounting assemblies 234 and 238.

Formed in mounting assembly 234 is a radially extending filling channel 248 which is sealed by a plug assembly 248. Communicating with channel 246 is a secondary channel 250 which leads to a pressure sensor 252. Pressure sensor 252 may be any suitable pressure sensor having a high speed response. In practice we use Model P 776-F-3505-T-X manufactured by WHITMAN-GENERAL and obtain a high speed response therewith for sensing discharge due to a Venturi suction effect. Pressure sensor 252 provides an output signal via an electrical cable 254 which is connected to a connector plug 256 which is mounted onto a sealed cover member 258 which covers the outlet end of the container.

Pressure sensor 252 performs a dual function, indicating the steady state pressure of the filled container and thus monitoring its operability, and also providing an immediate indication of discharge of the container by sensing the negative pressure produced in channels 246 and 250 by a flow of liquid extinguishing agent through the flowpath 260 by means of the Venturi suction effect.

A high speed pressure generator, typically a detonator 262 is mounted onto mounting assembly 238 and communicates with flowpath 260 only a via an inclined channel 264 formed in assembly 238 and arranged to face rupture disc 244. Detonate 262 is operated by an electrical signal transmitted via a cable 266, communicating with connector 256, to produce an immediate burst of pressure which passes through channel 264, and impinges directly on rupture disc 244, causing its rupture and permitting immediate and substantially unimpeded release of the pressurized extinguishing agent in the container.

It is a particular feature of the present invention that the pressure generator is disposed entirely outside of flowpath 260 and communicates only via a pressure channel therewith, so as not to interfere with the outflow of the extinguishing agent. Since the pressure sensor is similarly mounted outside of the flowpath, the extinguishing agent is afforded a substantially unobstructed flowpath once the rupture disc is broken.

Sealable cover 258 is secured onto a mounting collar 270 which may be welded or otherwise joined to the container 210. Cover 258 defines a short nozzle 272 which is aligned coaxially with flowpath 260 and is wider than the flowpath so as not to substantially interfere with the flow therepast.

It is a particular feature of the invention that the pressure sensor is operative to sense discharge of a cylinder within 10 msecs. of the discharge thereof and the actuation circuitry, such as control circuitry 20 operates an additional cylinder within 30 msecs. following a failure to discharge.

Reference is now made to FIGS. 7A–7D which show one embodiment of a deflector which may be used in association with the extinguishing material container illustrated exemplarily in FIG. 6. The deflector may comprise a generally pyramidal structure 300 formed of a plurality of planar portions 302 joined together at their respective side edges or drawn from one piece to define a common apex 304. The apex is normally arranged along a central axis 306 which is oriented parallel to the axis of the fluid flow along flowpath 260 (FIG. 6). The deflector may be symmetric about axis 306 and have a 360° exposure or it may have only a 150° exposure for example, depending on the desired application and the direction in which it is desired to deflect the extinguishing agent.

The deflector is normally mounted in a desired orientation onto the extinguishing agent container and is operative in accordance with a preferred embodiment of the invention to direct the flow of extinguishing agent in a desired direction with a minimum of friction and with a minimum of back pressure between the deflector and the container outlet which can impede discharge thereof.

Figure 8A:
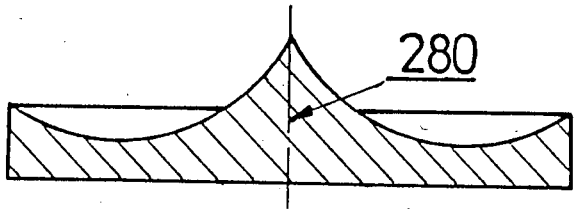
FIGS. 8A and 8B are illustrations of another embodiment of a deflector constructed and operative in accordance with an embodiment of the invention.
Figure 8B:
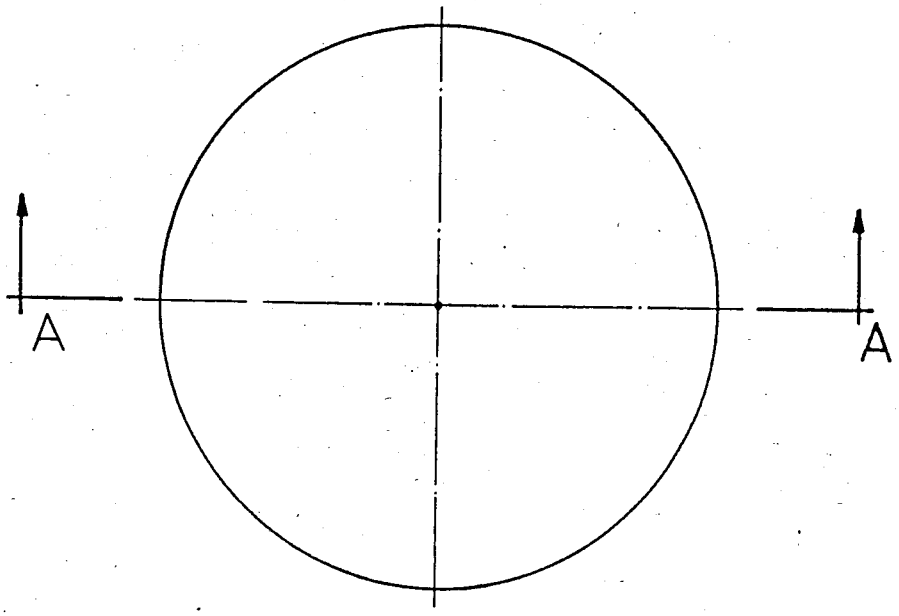

An alternative embodiment of deflector is illustrated in FIGS. 8A and 8B and comprises a symmetric configuration having a central cusp and a minor edge cusp when viewed in cross section. The deflector of FIGS. 8A and 8B is arranged about a central axis 280 which is usually aligned along the axis of flowpath 260 (FIG. 6) and provides a reversal of flow direction coupled with a radial distribution.

It will be appreciated that only exemplary embodiments of the invention have been specifically illustrated and described hereinabove. The invention is not limited to what has been specifically shown and described. Rather, the scope of the invention is defined only by the claims which follow:

We claim:

1. For use in a fire and explosion suppression system adapted to suppress an explosion within 100 milliseconds of the existence of a high energy ignition and within 200 milliseconds, of the existence of a low energy ignition, and comprising a plurality of detectors and a plurality of suppression elements communicating with a volume to be protected, actuation circuitry comprising:

means, operative in a normal mode of operation, for operating said suppression elements in response to different types of detection including:

first means operative in response to detection of a first type wherein a first number of detectors detect within a first time span for operating a first number of suppression elements; and second means operative in response to detection of a second type wherein a second number of detectors detect within a second time span for operating a second number of suppression elements greater than said first number of suppression elements;

said detection of said second type being characterized in that at least one of the following criteria are fulfilled:

(a) said second number of detectors exceeds said first number of detectors; and (b) said second time span is less than said first time span;

said actuation circuitry also comprising means, operative in a combat mode of operation, for operating at least two suppression elements in response to detection by at least one detector; and means for sensing the failure of a suppression element to operate and for operating an additional suppression element in response to said sensed failure.

2. Actuation circuitry according to claim 1 and wherein said means operative in a normal mode also comprises third means operative in response to detection by a third number of detectors for operating a third number of suppression elements.

3. Actuation circuitry according to claim 2 and wherein said third means is operative in response to detection by at least three detectors for operating two suppression elements.

4. Actuation circuitry according to claim 3 wherein said actuation circuitry is responsive to multiple detections including an earlier detection and a subsequent detection and is operative to respond to a subsequent detection within five seconds of the operation of a suppression element in response to an earlier detection.

5. Actuation circuitry according to claim 4 and wherein said means in said combat mode is operative for operating two suppression elements in response to detection by at least one detector.

6. Actuation circuitry according to claim 2 wherein said actuation circuitry is responsive to multiple detections including an earlier detection and a subsequent detection and is operative to respond to a subsequent detection within five seconds of the operation of a suppression element in response to an earlier detection.

7. Actuation circuitry according to claim 6 and wherein said means in said combat mode is operative for operating two suppression elements in response to detection by at least one detector.

8. Actuation circuitry according to claim 1 and wherein said first means is operative in response to detection by at least two detectors in more than 10 msecs for operating a single suppression element.

9. Actuation circuitry according to claim 8 and wherein said second means is operative in response to detection by at least two detectors in less than 10 msecs for operating two suppression elements.

10. Actuation circuitry according to claim 9 wherein said actuation circuitry is responsive to multiple detections including an earlier detection and a subsequent detection and is operative to respond to a subsequent detection within five seconds of the operation of a suppression element in response to an earlier detection.

11. Actuation circuitry according to claim 10 and wherein said means in said combat mode is operative for operating two suppression elements in response to detection by at least one detector.

* * * * *